US005478085A

United States Patent [19]

Canner et al.

[11] Patent Number: 5,478,085

[45] Date of Patent: Dec. 26, 1995

[54] MAGNETIC DOMINO SET

[76] Inventors: Bonnie Canner, 117 Tara Dr., East Hills, N.Y. 11576; Joel Berger, 2 Sandpiper Ct., Old Westbury, N.Y. 11568

[21] Appl. No.: 388,294

[22] Filed: Feb. 14, 1995

[51] Int. Cl.[6] ..... A63F 9/20

[52] U.S. Cl. ..... 273/239; 273/295; 273/293; 273/285; 273/282.2

[58] Field of Search ..... 273/295, 393, 273/239, 282.2, 456, 285, 286

[56] References Cited

U.S. PATENT DOCUMENTS

| | | | |
|---|---|---|---|
| 2,511,774 | 8/1945 | Goldsmith | 273/239 |
| 2,665,913 | 1/1954 | Hlavac | 273/239 |
| 3,652,086 | 12/1970 | Stecker | 273/148 R |
| 3,761,092 | 6/1971 | Shieff | 273/239 |
| 4,371,168 | 2/1983 | Dupuis | 273/239 |
| 4,761,010 | 8/1988 | Brotz | 273/275 |

FOREIGN PATENT DOCUMENTS

| | | | |
|---|---|---|---|
| 582488 | 6/1932 | Germany | 273/239 |
| 422102 | 8/1947 | Italy | 273/239 |
| 829342 | 3/1960 | United Kingdom | 273/239 |
| 2205251 | 12/1988 | United Kingdom | 273/239 |

*Primary Examiner*—Benjamin H. Layno
*Attorney, Agent, or Firm*—Jonathan E. Grant

[57] ABSTRACT

A magnetic domino set is disclosed comprising a set of dominoes magnetically attracted to a playing surface which, when folded, also serves as an attractive carrying case for the dominoes.

14 Claims, 1 Drawing Sheet

1
2
3
4
5
6
7
8
9
10
11
12
13
14
15
16
17
18

MAGNETIC DOMINO SET

BACKGROUND OF THE INVENTION

1. Field of the Invention

The present invention discloses a magnetic domino set.

2. Description of the Prior Art

A number of different magnetic board games or domino games for entertainment have been invented over the years.

U.S. Pat. No. 2,511,774 (R. H. Goldsmith) discloses a magnetic game board and cover for use by travelers. The playing board surface forms part of a light box, provided with drawers for holding the men or pieces used in playing the game, and provided with holding devices which may take the form of magnetic units for holding the men when placed upon the squares or other divisions of the board surface. In this invention, a magnet forms part of each square of the board and is effective on magnetic units carried by the pieces. Thus the magnets tend to center the pieces in the squares of the board. The cover may take the form of an arched set of plastic extending completely over the board and covering the ends of the drawers and carry the partitions on its lower face so that they serve as stiffening girders enabling the cover to be formed of exceedingly light material.

U.S. Pat. No. 2,665,913 (Hlavac) discloses a magnetic chess set, having magnets held by pins into the bottom of each chess piece so that the pieces attach to a playing board of magnetic metal. The game board is built up of many superimposed layers and consists of a base layer of heavy cardboard, wood or other similar non-magnetic material. A metallic member is secured to the top face of the base layer by a layer of mucilage, and is in the form of a thin sheet or foil of a magnetic material. A cover layer, residing on top of the metallic layer, consists of a sheet of heavy paper, leather, leatherette, cloth or the like material. The game piece is characterized by a body member which is molded or shaped by any desired non-magnetic material such as wood, ivory or one of the synthetic resinous materials. A metallic magnetic member is positioned in the bottom of the game piece. A cover sheet is extended across the open bottom of the body member so as to close the cavity wherein the magnet rests. In constructing the game apparatus, the metallic member of the game board or the metallic member of the game piece is actually magnetized to be magnetically attracted to the metallic member of the other and so hold the game piece in a desired shifted position on the surface of the board.

U.S. Pat. No. 3,652,086 (Stecker) discloses a dice, card and token box convertible to a dice throwing area. The inner horizontal surface of the box is lined with a sound absorbent material such as felt. The bottom half of the box has two tabs attached to its opposed vertical sides, with the tabs providing a lick for keeping the top half of the box in the same plane as the bottom half, once the box has been unfolded.

None of the prior art, however, suggests a magnetic domino set, wherein the case in which the dominoes serves as the domino playing surface.

SUMMARY OF THE INVENTION

The present invention discloses a portable magnetic domino set for use while traveling in a moving vehicle, or to use at home or at parties.

The magnetic domino set comprises a set of dominoes and a foldable box of substantially rectangular shape having a plurality of sections folded in on one another, the foldable box having at least a top section and a bottom section, wherein the foldable box when fully or partially unfolded, reveals a plurality of playing surfaces corresponding to the plurality of sections. At least either the top section or the bottom section, and preferably both sections, further comprise sides positioned on the outside edges of and perpendicular to the surface of each section so that the dominoes may be carried in the box when the box is folded. Additionally, the set of dominoes are magnetically attracted to the plurality of playing surfaces. The top surface of the dominoes of the invention comprise the traditional markings found on dominoes.

BRIEF DESCRIPTION OF THE DRAWINGS

The above and other objects, features and advantages of the present invention will become more readily apparent from the following description, reference being made to the accompanying drawings in which.

DESCRIPTION OF THE PREFERRED EMBODIMENT

Figures 1, 2, 3, 4:
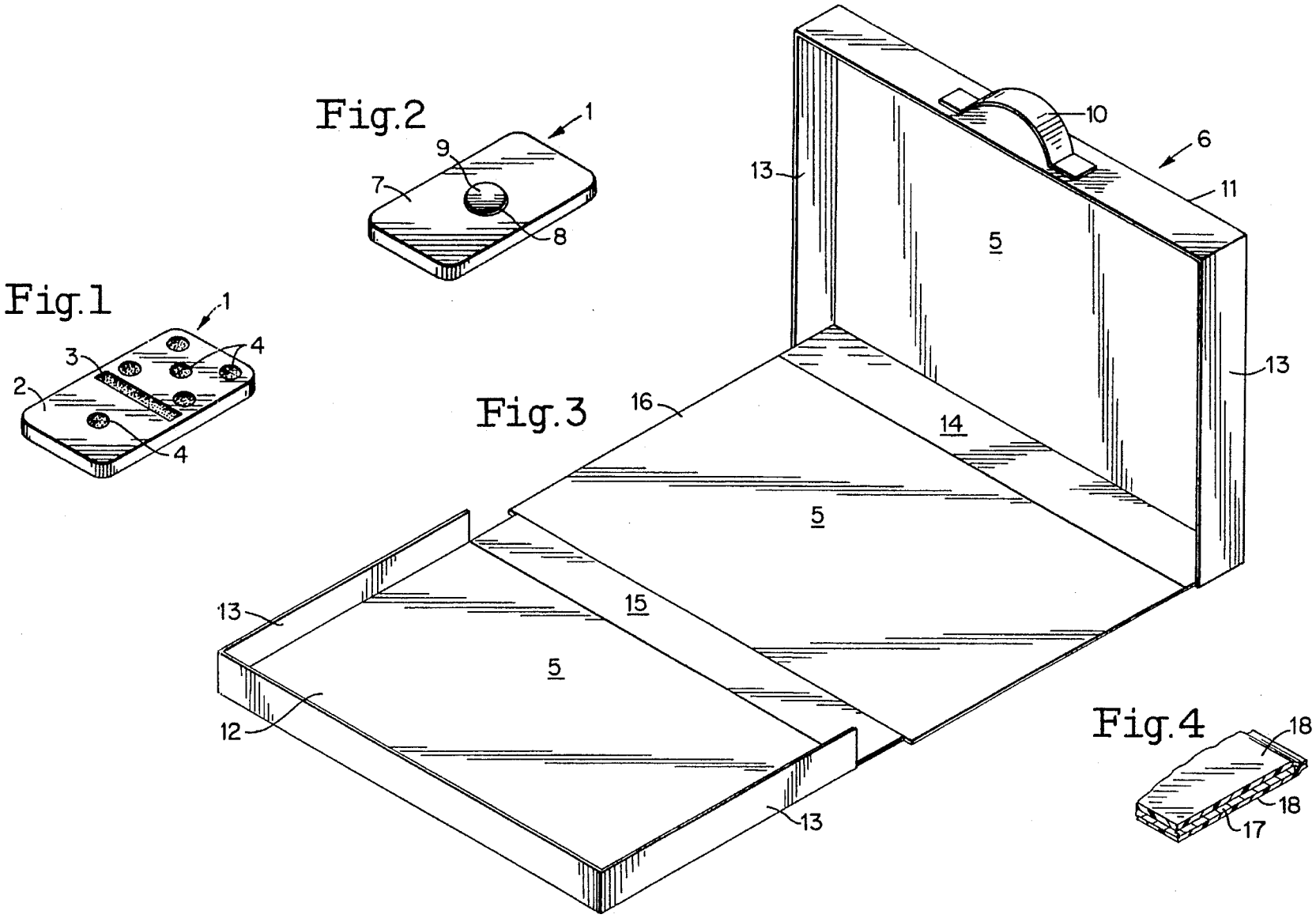
FIG. 1 is an overhead side view of the domino.
FIG. 2 shows the underside of the domino.
FIG. 3 shows the box in its open position.
FIG. 4 is a cutaway side view of the box.

Each domino may be made of wood, plastic, bone, cardboard, or any other suitable material. In more deluxe versions of the game, the dominos may be made out of abalone, onyx, walnut, or other luxurious materials. Preferably the domino is made out of a phenolic resin. The phenolic resin is strong and durable, and can be easily cleaned, when necessary, with water.

Referring to FIGS. 1 and 2, the face 2 of each domino 1 is divided, by a line or a ridge 3, into two approximately square ends, and is marked 4 similarly to a pair of dice side by side except that some ends are blank. The usual set comprises 28 pieces, respectively marked 6-6 ("Double six," etc.) 6-5, 6-4, 6-3, 6-2, 6-1, 6-0, 5-5, 5-4, 5-3, 5-2, 5-1, 5-0, 4-4, 4-3, 4,2, 4-1, 4-0, 3-3, 3-2, 3-1, 3-0, 2-2, 2-1, 2-0, 1-1, 1-0, 0-0. Any group of pieces having a common end comprise a suit. Of two bones, the one bearing the greater number of dots is heavier, the other lighter. Some sets run up to 9-9 and others as high as 12-12.

Each domino 1 is magnetically attracted to the playing surface 5 of the foldable box 6, shown in FIG. 3. In one embodiment of the invention, the back 7 of each domino 1 has a metallic strip or backing which is magnetically attracted to the playing surface of the board. There may be an indentation 8 in the back of each domino 1 into which a metallic piece is affixed so that the domino is magnetically held to the magnetized board surface.

In a preferred embodiment of the invention, the back 7 of each domino contains a magnet 9, which is attracted to the playing surface of the game. Specifically, the domino 1 may have an indentation 8 into which a magnet is affixed, preferably by glue. In other embodiments of the invention, the magnet may be held by pins, screws, or by any other means.

In yet another embodiment of the invention, the entire back surface 7 of the domino 1 may be metallic or a magnet. The magnet or the metallic back surface may preferably be affixed by an adhesive.

In addition to comprising a set of dominoes, the magnetic domino set comprises a foldable box 6 of substantially rectangular shape having a plurality of sections folded in on one another, wherein the foldable box when fully or partially unfolded, reveals a plurality of playing surfaces 5 corresponding to the plurality of sections. The box has at least one top section 11 and one bottom section 12, and preferably with sides 13 on each section so that the dominoes may be carried in the box when the box is folded. Hinged portions 14, 15 between each section allow for the sections to be folded one on top of another while leaving space in which the dominoes may be stored.

Preferably, the box comprises three sections, including a middle section 16 on which the dominoes may be positioned. Additionally, the hinged portions 14, 15 of the box may allow for at least one of the sections of the box to be positioned at 90 degree angles forming a "wall" such that the playing surface for the dominoes may be three dimensional.

As shown in FIG. 4, the box is comprised of preferably at least two layers. The inner layer 17 is either a metallic sheet to which dominoes containing magnets may be attracted, or a magnetized metallic sheet to which the dominoes containing a metal piece are attracted.

There is also preferably an outer layer or covering 18, made of plastic, vinyl, polybutylene, rubber paper, or cardboard, but preferably vinyl. In a more deluxe version of the magnetic domino set, the outer covering 18 may be a thin leather.

The outer covering 18 may be fitted over the inner layer 17 and hermetically sealed along the seams or along the edges of the inner layer 17. Alternatively, the outer covering 18 may also be glued to the inner layer 17, riveted, or attached by any other means.

Both the inner metallic sheet and the outer covering should be thin and light weight. The metallic sheet should be between about 0.25 and 2.5 mm thick, and the outer covering should be between about 0.10 and 1.5 mm thick.

In another embodiment of the invention, a handle 10 and/or lock is positioned on the top outside side 13 of one of the sections.

Many modifications and variations of the present invention are possible in light of the above teachings. It is, therefore, to be understood within the scope of the appended claims the invention may be protected otherwise than as specifically described.

What is claimed is:

1. A magnetic domino set comprising:

a set of dominoes;

a foldable box of substantially rectangular shape, said foldable box have a plurality of sections folded in on one another, the plurality of sections comprising at least a top section and a bottom section, wherein the foldable box, when fully or partially unfolded, has a plurality of playing surfaces corresponding to the plurality of sections, and wherein the dominoes of said set are magnetically attracted to said playing surfaces of said foldable box.

2. The magnetic domino set of claim 1, further comprising sides positioned on the outside edges of and perpendicular to an inside playing surface of said top section of said foldable box, and to an inside playing surface of said bottom section of said foldable box, wherein said dominoes may be carried within said foldable box when said box is folded.

3. The magnetic domino set of claim 1, wherein said dominoes are made of material selected from the group consisting of wood, plastic, bone, cardboard, abalone, and onyx.

4. The magnetic domino set of claim 1, wherein the back of each said domino has a metallic strip magnetically attracted to the playing surface of the board.

5. The magnetic domino set of claim 1, wherein the back of each domino has a backing magnetically attracted to the playing surface of the board.

6. The magnetic domino set of claim 1, wherein there is an indentation in the back of each said domino into which a metallic piece is affixed so that the domino is magnetically held to the magnetized board surface.

7. The magnetic domino set of claim 1, wherein the back of each said domino contains a magnet which is attracted to the playing surface of the board of the magnetic domino set.

8. The magnetic domino set of claim 6, wherein said metallic piece is a magnet.

9. The magnetic domino set of claim 1, wherein the foldable box further comprises at least one hinged portion between each section allowing for the sections to be folded one on top of another while leaving space in which the dominoes may be stored when said box is folded.

10. The magnetic domino set of claim 1, wherein the foldable box, comprises three said sections, which, when in the open position reveals said playing surfaces on which the dominoes may be positioned.

11. The magnetic domino set of claim 9, wherein the hinged portions of the foldable box allow for at least one of the sections of the box to be positioned a 90 degree angle, therein forming a wall allowing the dominoes to be placed at 90 degree angles to one another on said playing surfaces.

12. The magnetic domino set of claim 1, wherein the foldable box is further comprised of at least an inner layer comprised of a metallic sheet to which said dominoes are magnetically attracted, and an outer covering, said outer covering comprised of a material selected from the group consisting of plastic, vinyl, polybutylene, rubber, paper, cardboard, leather and combinations thereof.

13. The magnetic domino set of claim 12, wherein said outer covering is attached to the inner layer.

14. The magnetic domino set of claim 12, wherein the inner metallic sheet is between about 0.25 mm and 2.5 mm thick, and the outer covering is between about 0.10 and 1.5 mm thick.

* * * * *